US006450245B1

(12) United States Patent
Chen

(10) Patent No.: US 6,450,245 B1
(45) Date of Patent: Sep. 17, 2002

(54) AIR PREHEATER HEAT TRANSFER ELEMENTS

(75) Inventor: Jianrong Chen, Wellsville, NY (US)

(73) Assignee: ALSTOM (Switzerland) Ltd., Baden (CH)

( * ) Notice: Subject to any disclaimer, the term of this patent is extended or adjusted under 35 U.S.C. 154(b) by 0 days.

(21) Appl. No.: 10/039,959

(22) Filed: Oct. 24, 2001

(51) Int. Cl.[7] ..... E28D 19/00

(52) U.S. Cl. ..... 165/10; 165/8; 165/DIG. 42; 261/112.2

(58) Field of Search ..... 165/8, 10, DIG. 42, 165/166; 261/112.2

(56) References Cited

U.S. PATENT DOCUMENTS 2,558,752 A 7/1951 Holm ..... 257/6
3,308,876 A * 3/1967 Gram et al. ..... 165/10
5,513,695 A * 5/1996 Harting ..... 165/8
5,836,379 A * 11/1998 Counterman ..... 165/10
5,899,261 A * 5/1999 Brzytwa et al. ..... 165/8
5,983,985 A * 11/1999 Counterman et al. ..... 165/8
6,145,582 A * 1/2000 Bolle et al. ..... 165/10
6,019,160 A * 2/2000 Chen ..... 165/10
6,179,276 B1 * 1/2001 Chen et al. ..... 261/112.2
6,253,833 B1 * 7/2001 Koster et al. ..... 165/10

* cited by examiner

*Primary Examiner*—Henry Bennett
*Assistant Examiner*—Terrell McKinnon
(74) *Attorney, Agent, or Firm*—Alix, Yale & Ristas, LLP

(57) ABSTRACT

A heat transfer element assembly for a rotary regenerative air preheater for spacing the heat transfer plates to optimize performance and reduce costs. Rectangular or trapezoidal spacer tabs are punched and bend outwardly from the plates and arranged in parallel rows. The tabs have specific height and length ranges and ratios and the area of the tabs to the area of the remaining portion of the plate has a specific ratio range.

3 Claims, 5 Drawing Sheets

AIR PREHEATER HEAT TRANSFER ELEMENTS

BACKGROUND OF THE INVENTION

The present invention relates to rotary regenerative heat exchangers and particularly to air preheaters for the transfer of heat from a flue gas stream to an incoming combustion air stream. The invention particularly relates to the structure and configuration of the heat transfer plates contained in such heat exchangers.

A rotary regenerative heat exchanger is employed to transfer heat from one hot gas stream, such as a hot flue gas stream, to another cold gas stream, such as combustion air. The rotor contains a mass of heat absorbent material which first rotates through a passageway for the hot gas stream where heat is absorbed by the heat absorbent material. As the rotor continues to turn, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a horizontal or vertical central rotor post and divided into a plurality of sector-shaped compartments by a plurality of radial partitions, referred to as diaphragms, extending from the rotor post to the outer peripheral shell of the rotor. These sector-shaped compartments are loaded with modular heat exchange baskets which contain the mass of heat absorbent material commonly formed of stacked heat transfer plates. These heat transfer plates are closely stacked in spaced relationship to provide a plurality of passageways between adjacent plates for flowing the heat exchange fluids therebetween.

In order to maintain the plates in the spaced relationship, a whole variety of devices or configurations have been proposed in the past. One such configuration is disclosed in U.S. Pat. No. 2,558,752 wherein the plates are provided with tabs punched and bent from the plates to form spacers. Although this is a viable means for stacking and spacing the plates, and although they exhibit favorable heat transfer rates, the results can vary widely depending on the specific design and the tab dimensions. Also, factors other than thermal performance are important such as the structural rigidity, the pressure drop and cost factors such as the volume and weight of the plates necessary for a certain level of performance.

SUMMARY OF THE INVENTION

An object of the present invention is to provide improved heat transfer means for rotary regenerative heat exchangers and particularly to improved means for spacing heat transfer plates in such heat exchangers to optimize performance and reduce costs. In accordance with the invention, the heat transfer plates have spacer tabs punched and bent outwardly from the plates arranged in parallel rows wherein the tabs have specific ranges and ratios of dimensions to optimize the thermal performance, provide structural rigidity and reduce the cost, weight and volume.

DESCRIPTION OF THE PREFERRED EMBODIMENT

Figure 1:
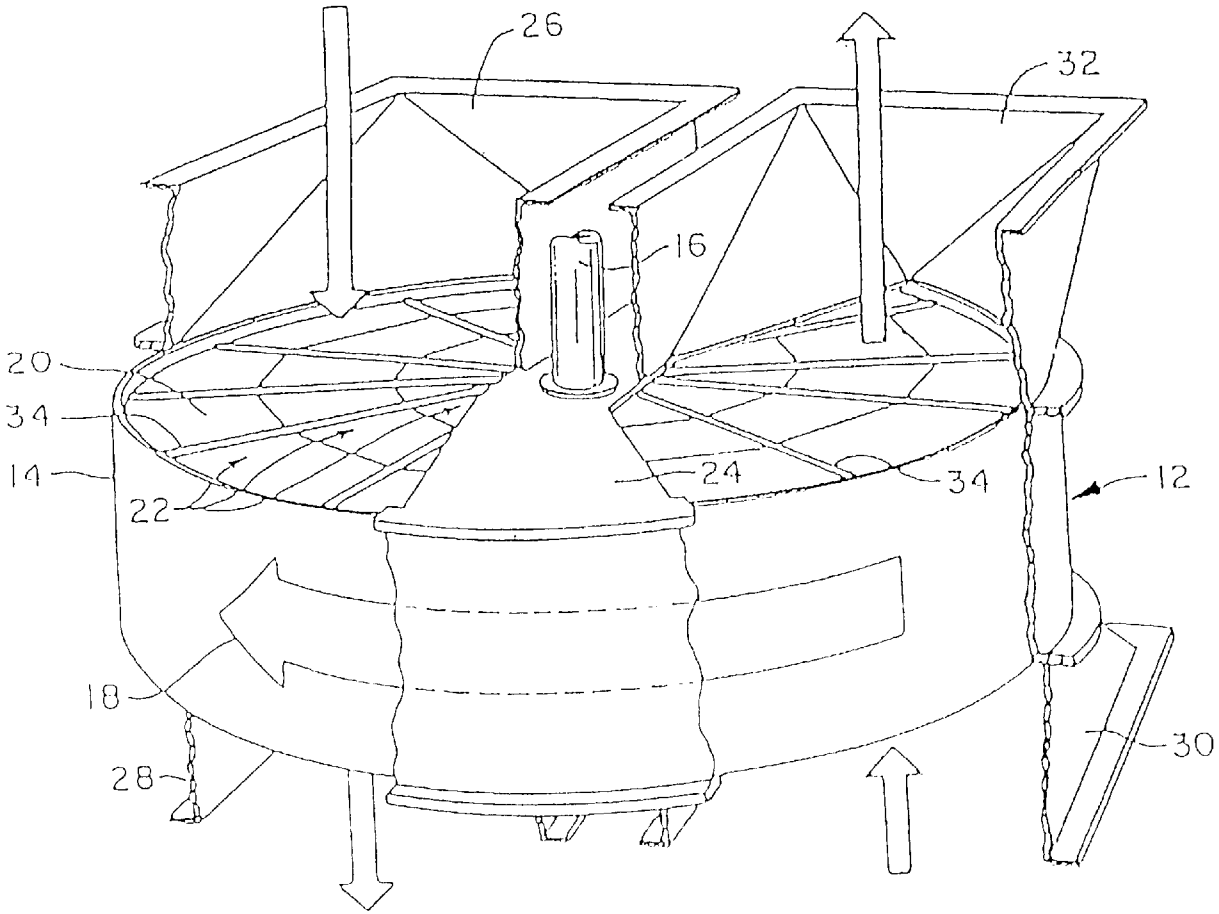
FIG. 1 is a perspective view of a conventional rotary regenerative air preheater which contains heat transfer element assemblies each containing heat transfer plates.

FIG. 1 of the drawings is a partially cut-away perspective view of a typical air heater showing a housing 12 in which the rotor 14 is mounted on a drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit.

The hot flue gases enter the air heater through the gas inlet duct 26, flow through the rotor where heat is transferred to the rotor and then exit through gas outlet duct 28. The counter current flowing air enters through the air inlet duct 30, flows through the rotor where it picks up heat and then exits through air outlet duct 32.

Figure 2:
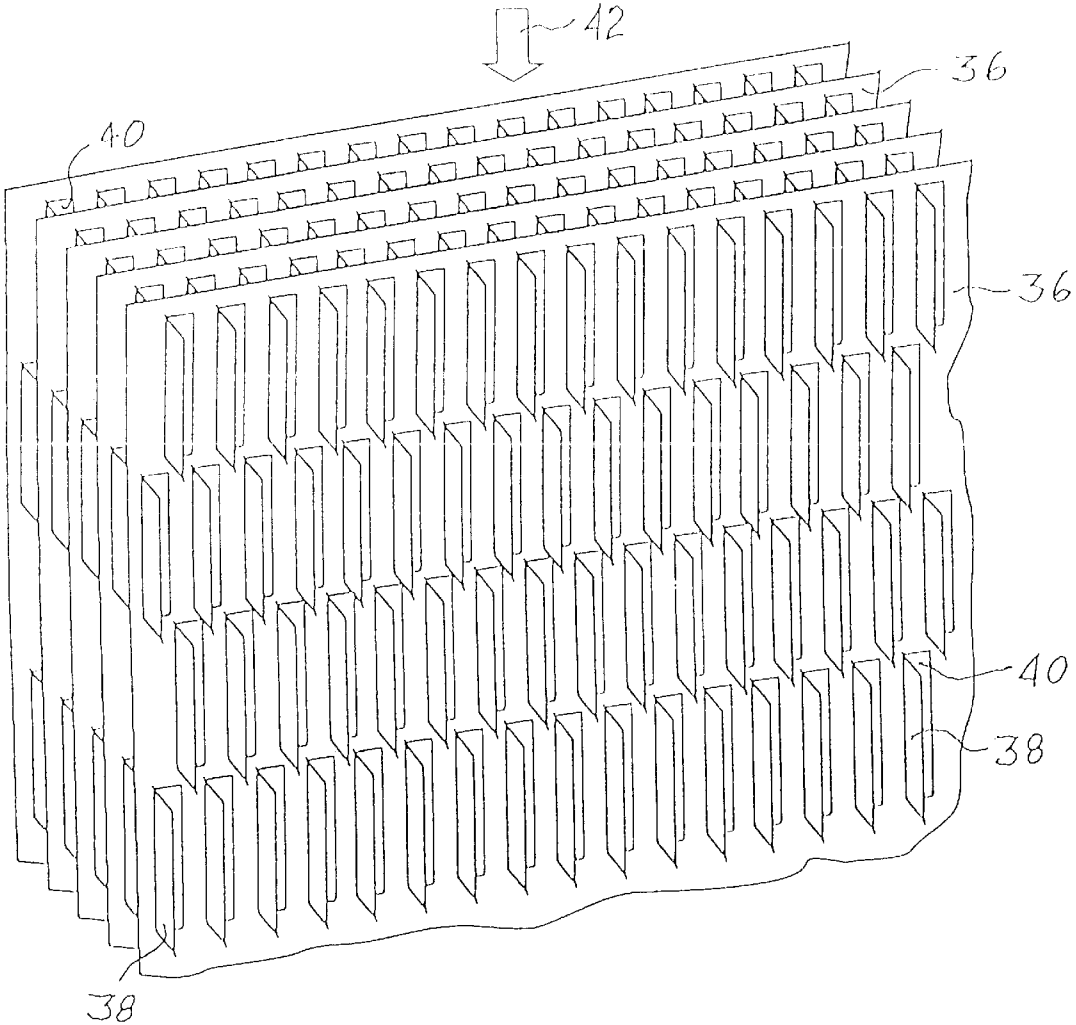
FIG. 2 is a perspective view of portions of a plurality of stacked heat exchange plates incorporating the spacing tabs of the present invention.
Figure 3:
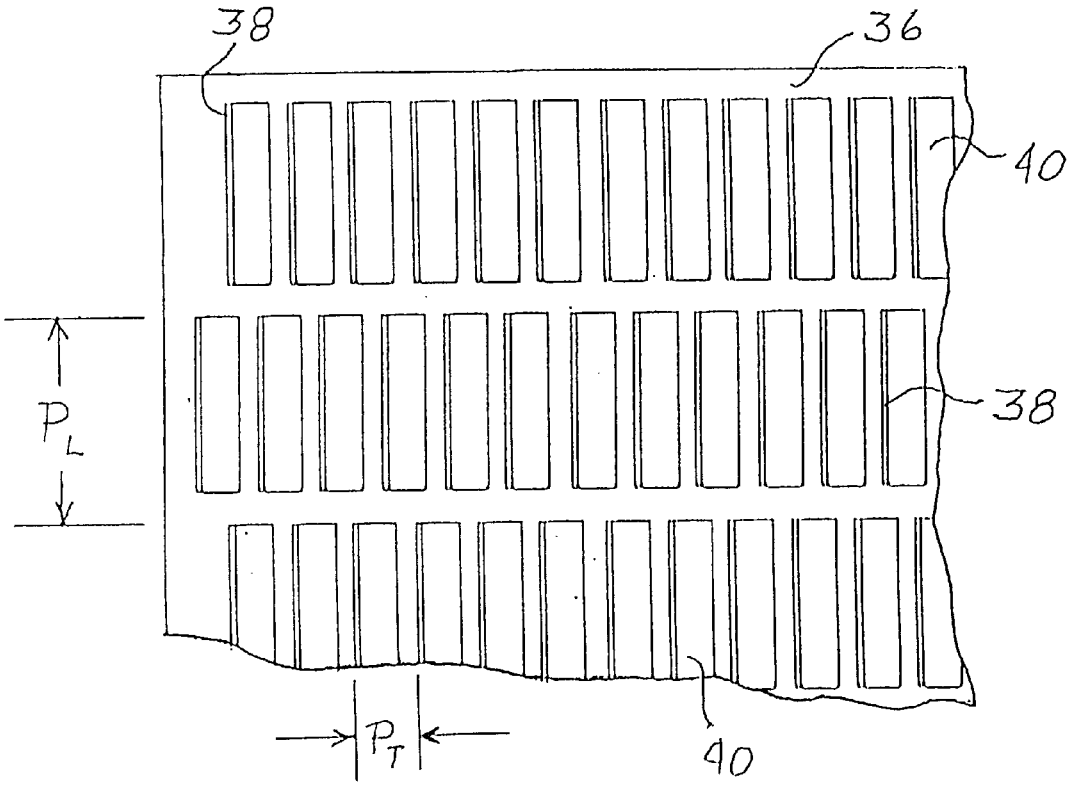
FIG. 3 is a face view of a portion of one of the plates of FIG. illustrating the spacing of the tabs.
Figure 4:
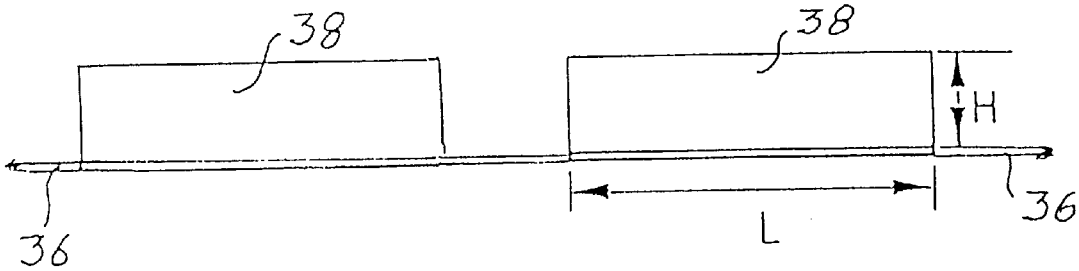
FIG. 4 is a side view of a portion of one of the plates illustrating the height and length of the tabs.
Figure 5:
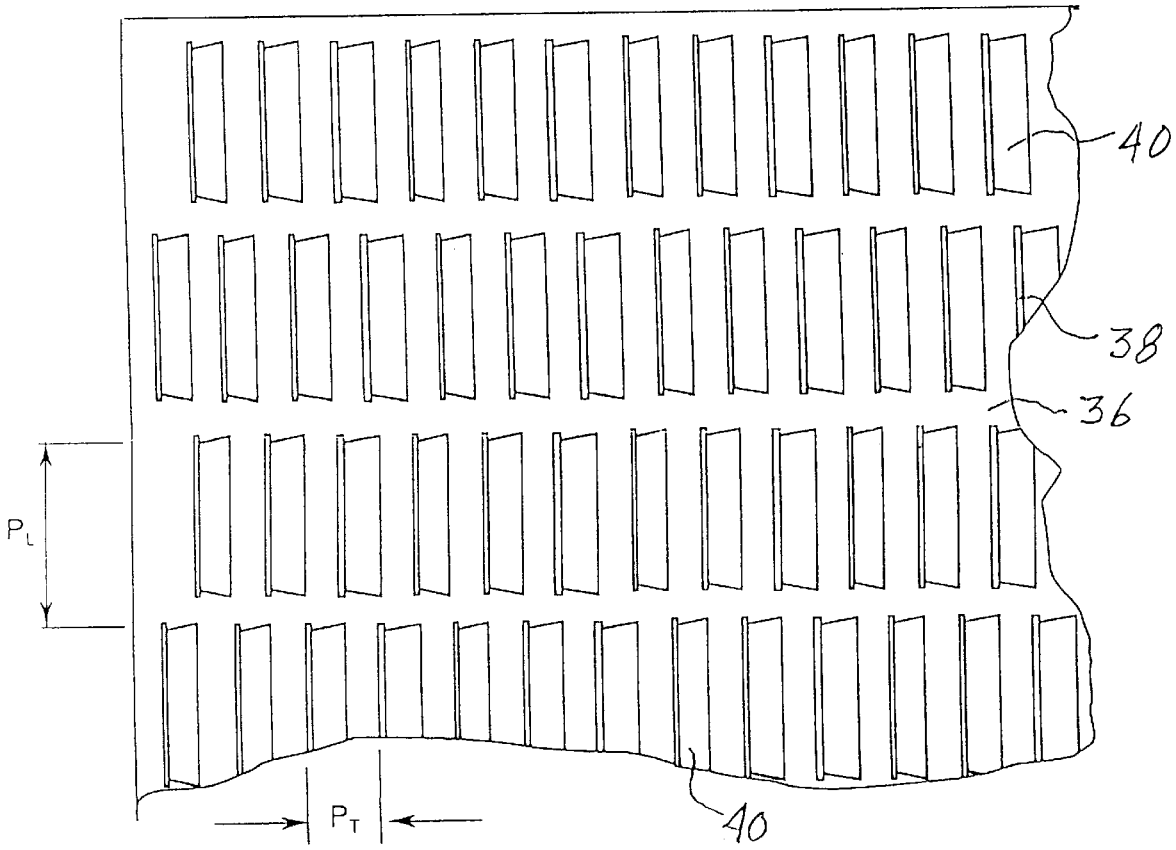
FIGS. 5 and 6 are views of a portion of a plate similar to FIGS. 3 and 4 but illustrating trapezoidal tabs.
Figure 6:
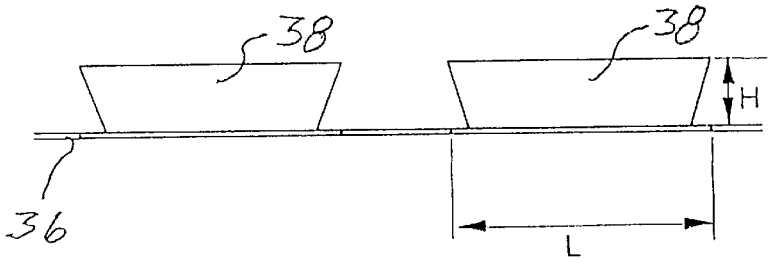

FIG. 2 is a perspective view of a series of stacked and spaced plates of the present invention as would be contained in the basket modules 22 of FIG. 1. Each plate 36 is formed of thin sheet metal as typically used as heat transfer plates in air preheaters. Each plate is formed over substantially its entire area with a series of elongated spacing tabs 38 arranged in parallel rows. The tabs 38 are formed by perforating the plates along three sides of each tab and then bending the tabs along the fourth attached side outwardly from the plane of the plate at right angles leaving the apertures 40. Each tab lies in a plane parallel to the direction of fluid flow as indicated by the arrow 42. Preferably, the tabs in each row are offset from the tabs in the adjacent rows as illustrated. The tabs may be rectangular as shown in FIGS. 2, 3 and 4 or trapezoidal as shown in FIGS. 5 and 6.

In the present invention, the optimum combination of thermal performance and reduced heat transfer element weight and volume are achieved by the following configuration parameters:

$$0.15'' < H < 0.25''$$
$$1.0 < L/H < 9.0$$
$$0.5 < A_t/A_b < 1.0$$

where:

H=tab height as in FIGS. 4 and 6

L=tab length as in FIGS. 4 and 6

$A_t$=total area of the tabs on a plate $A_b$=area of the remaining plate

With an L/H ratio greater than 1.0 and less than 9.0, the thermal performance is optimized with an acceptable pressure drop. In order to optimize the thermal performance and provide sufficient structural integrity, the transverse pitch $P_t$ of the tabs in the direction perpendicular to the fluid flow and the longitudinal pitch $P_l$ in the direction parallel to the fluid flow as shown in FIGS. 3 and 5 are selected such that the ratio of the total area of all of the tabs on a plate, $A_t$, to the area of the base, $A_b$ (total plate area minus total tab area), is greater than 0.5 and less than 1.0. The further limitation is the range of 0.15 to 0.25 inches for the height H of the tabs and thus the spacing of the plates so as to minimize the volume and weight of the heat transfer assemblies.

Figure 7:
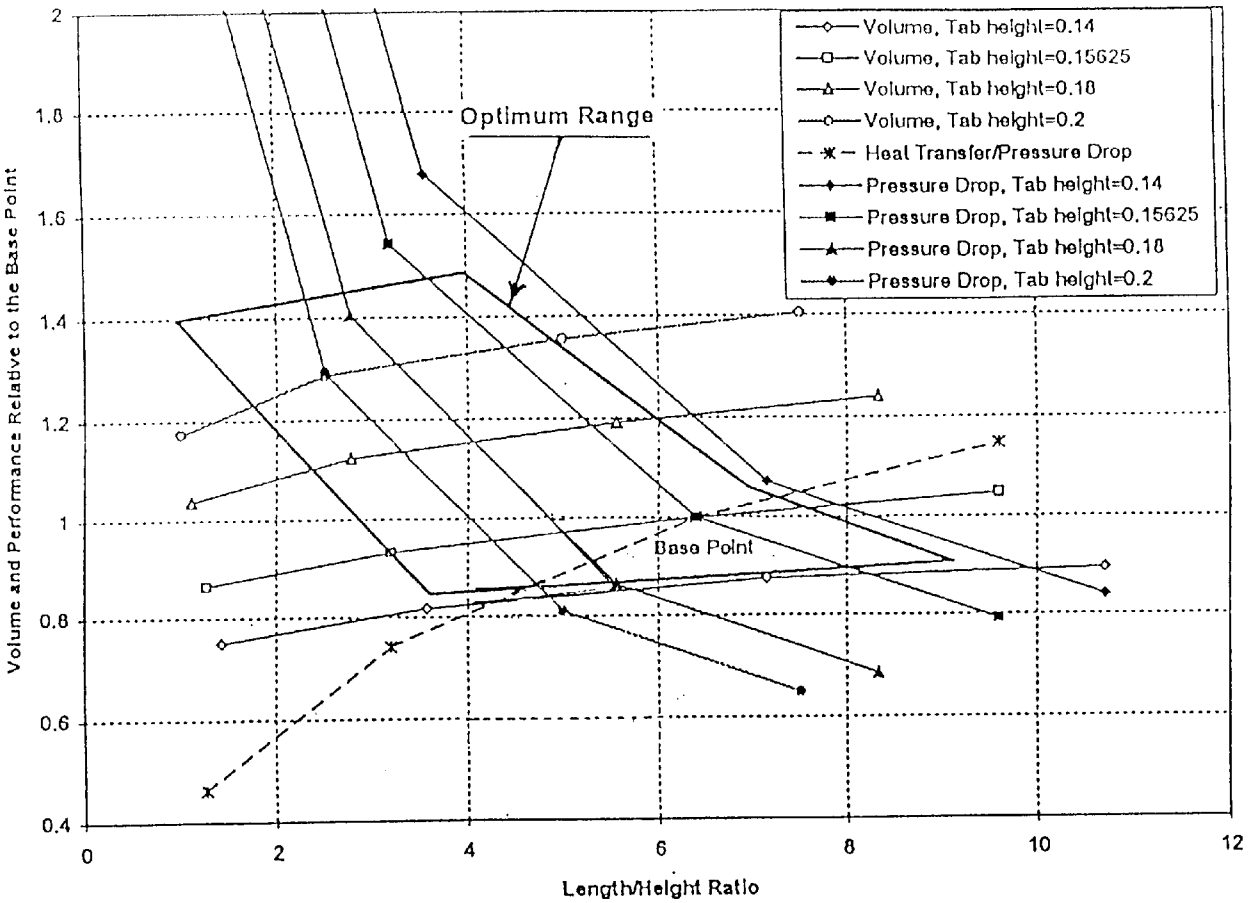
FIG. 7 is a graph illustrating the effect of the parameters of the heat transfer plates of the invention.

The graph of FIG. 7 illustrates the effect of geometrical parameters of the tabs on the volume, pressure drop and heat transfer of an air preheater employing the invention. The enclosed area defines the optimum range for the present invention. Specifically, the graph illustrates the effect of the tab height H and the ratio L/H on these performance factors.

As one comparison of the benefits of the present invention, an air preheater containing the heat transfer plates of the present invention with a tab height of 0.156 inches has a volume which is 36.4% less and a heat transfer plate weight which is 32.4% less than the volume and weight factors for an air preheater containing conventional undulating heat transfer plates for the same level of performance.

Another comparison involves replacing the conventional undulating plates in an existing air preheater with plates according to the present invention at two different tab heights without a change in pressure drop.

At a tab height of 0.16 inches, the heat transfer is increased 34.4% while the heat exchange element weight is increased only 3.9%. At a tab height of 0.25 inches, the heat transfer is increased 6.3% while the heat exchange element weight is decreased 30.9%.

What is claimed is:

1. A heat transfer element assembly for a rotary regenerative heat exchanger comprising a plurality of heat exchange plates each having ends and two opposed planar surfaces and being stacked in spaced relationship thereby providing passageways between adjacent heat exchange plates for the flow of heat exchange fluids therebetween from end-to-end, each of said heat exchange plates comprising:

(a) a base plate;

(b) a plurality of elongated tabs cut along three edges from said base plate and bent outwardly from said base plate along a fourth edge perpendicular to one planar surface of said base plate, said tabs thereby forming spacers between adjacent heat exchange plates; and (c) perforations in said base plate formed by said elongated tabs bent outwardly therefrom thereby leaving a remaining portion of said base plate, wherein said tabs have a height H and a length L along said fourth edge and wherein H is more than 0.15 and less than 0.25 and L/H is greater than 1.0 and less than 9.0 and the ratio of the area of the tabs on each plate to the area of the remaining portion of said base plate is greater than 0.5 and less than 1.0.

2. A heat transfer element assembly as recited in claim 1 wherein said elongated tabs are rectangular.

3. A heat transfer element assembly as recited in claim 1 wherein said elongated tabs are trapezoidal.

* * * * *